United States Patent [19]

Gabor

[11] 4,100,642

[45] Jul. 18, 1978

[54] PAINT ROLLER AND BRUSH COMBINATION

[75] Inventor: Charles K. Gabor, Astoria, N.Y.

[73] Assignee: The Raymond Lee Organization, Inc., New York, N.Y.

[21] Appl. No.: 771,071

[22] Filed: Feb. 23, 1977

[51] Int. Cl.[2] ..... A46B 15/00; B05C 17/02

[52] U.S. Cl. ..... 15/114; 15/230.11

[58] Field of Search ..... 15/27, 114, 230.11, 15/248 A; 401/197, 208, 218, 219, 21, 22, 24

[56] References Cited

U.S. PATENT DOCUMENTS

| | | | |
|---|---|---|---|
| 756,695 | 4/1904 | Peterson | 15/114 X |
| 3,088,152 | 5/1963 | Lucas | 15/248 A X |
| 3,369,269 | 2/1968 | Deck et al. | 15/114 |

FOREIGN PATENT DOCUMENTS

| | | | |
|---|---|---|---|
| 1,034,900 | 4/1953 | France | 15/114 |
| 99,837 | 4/1962 | Norway | 15/114 |
| 8,460 | 4/1894 | Switzerland | 401/208 |
| 954,819 | 4/1964 | United Kingdom | 15/114 |
| 887,294 | 1/1962 | United Kingdom | 15/248 A |

*Primary Examiner*—Daniel Blum

*Attorney, Agent, or Firm*—Howard I. Podell

[57] ABSTRACT

A paint roller, with a brush detachably and adjustably fastened to the handle arm, with the bristle section of the brush spaced from the roller so as to brush a surface that the roller has contacted for the purpose of brushing of the paint applied to the surface by the roller.

1 Claim, 4 Drawing Figures

PAINT ROLLER AND BRUSH COMBINATION

SUMMARY OF THE INVENTION

My invention is a paint roller, with a brush detachably and adjustably fastened to the handle arm, with the bristle section of the brush spaced from the roller so as to brush a surface that the roller has contacted for the purpose of brushing of the paint applied to the surface by the roller.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
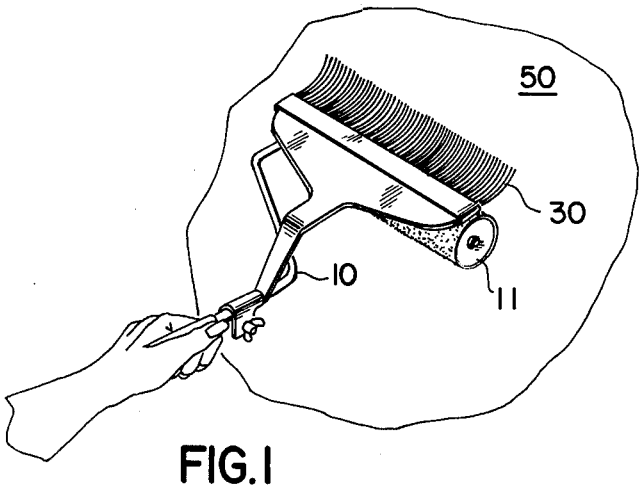
FIG. 1 is a perspective view of the invention, in use.
Figure 2:
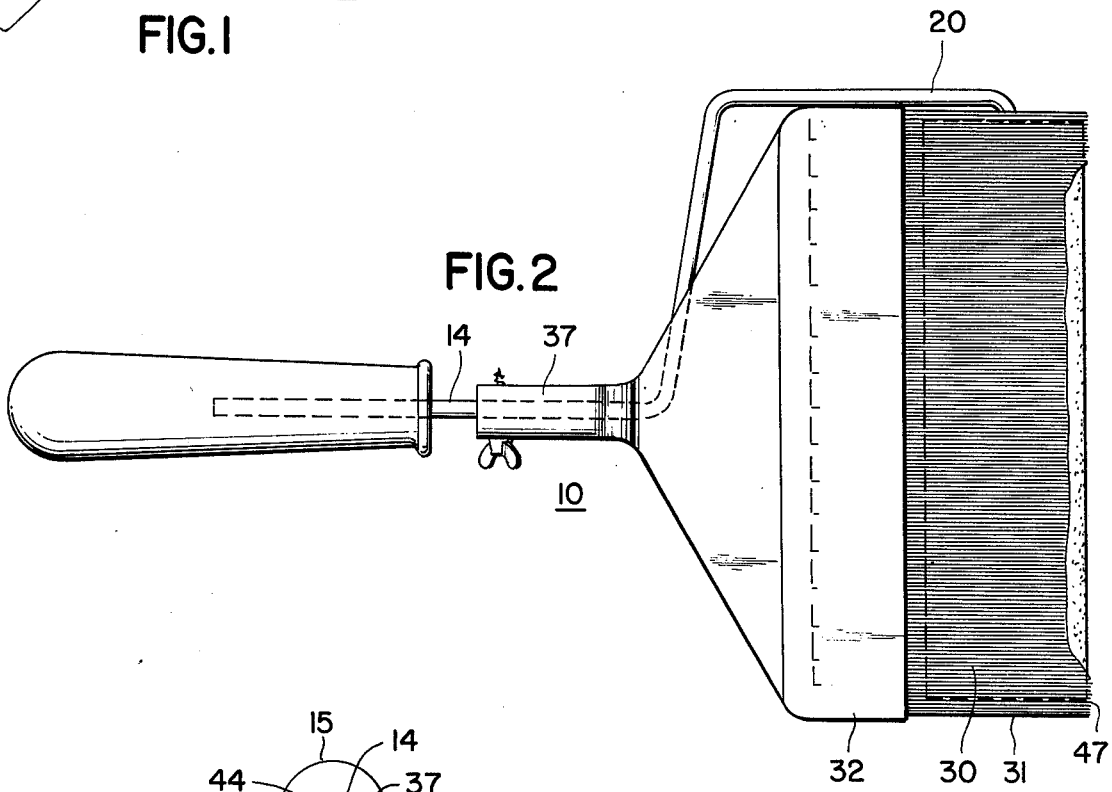
FIG. 2 is a plan view of the invention.
Figure 4:
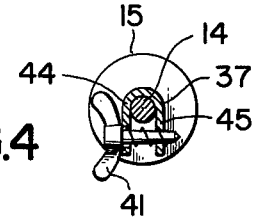
FIG. 4 is a sectional view taken through line IV—IV of FIG. 3.
Figure 3:
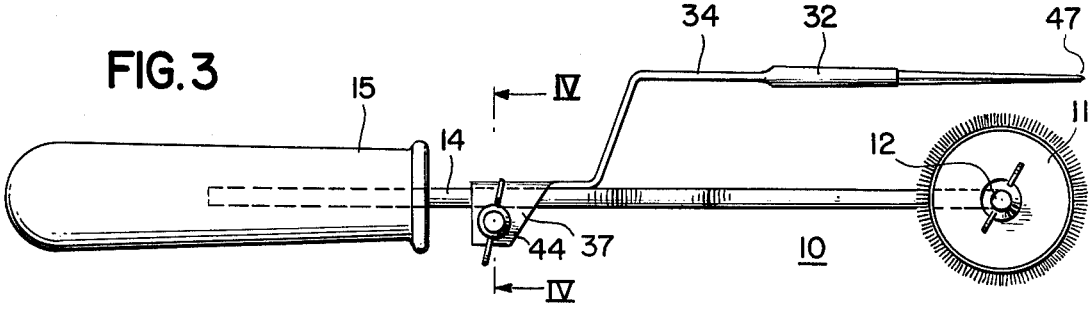
FIG. 3 is a side view of the invention.

Turning now descriptively to the drawings, in which similar reference characters denote similar elements throughout the several views, FIGS. 1–4 illustrate the roll brush 10. A paint roller 11 is rotatably mounted on a straight axle section 12 of a bent wire 20 in the shape of a crank arm, with wire 20 shaped to freely extend about the exterior of the roller and terminate in a straight handle section 14 oriented perpendicular to the axle section and pointing away from the general mid-point of the axle section, with handle section 14 terminating in a handle 15 in which it is embedded.

Brush unit 30 is formed of a plurality of bristles 31 clamped in a bristle holder unit 32 such that the bristles extend in parallel orientations perpendicularly to the straight edge of the bristle holder unit 32 which is the general length of roller 11. Bristle holder unit is fixed to a first sheet section 34 that projects from the rear of the bristle holder unit 32 to join a second sheet section extending at an angle to the plane of the first section, with said second sheet section terminating in a U-shaped clamp section 37 of a size to fit about handle section 14 of the roller wire 20. A thumbscrew 41 freely fits through a hole in a first leg section 44 of clamp section 37 to threadably engage a threaded hole in the second leg section 45 of clamp section 37 for tightening clamp section 37 in place at a desired location on handle section 14.

Since handle section 14 extends normal to the axis of the roller axle, the tip edges 47 of brush unit 30 may be located at a desirable distance from handle section 14 so that the bristles 31 contact the surface 50 against which the roller is applying paint so that the bristles brush the paint applied by the roller. The brush section or the roller may each be used separately or both together.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A paint roller unit to which a paint brush unit is adjustably mounted so that the brush unit may simultaneously contact a surface against which the roller of the roller unit is rolled, said roller unit formed of a paint roller rotatably mounted to a crank arm, said crank arm lying substantially in a single plane and terminating in a straight handle section extending substantially perpendicular to the axle section of the crank arm and pointing away from the general mid-point thereof, said brush unit formed of a plurality of bristles fixed, lying in a plane substantially parallel to the handle section, fixed to a first section of a sheet member and overlying the paint roller, with a second opposed section of said sheet member bent as a U-shaped clamp section of a size to fit about the straight handle section of the roller unit, said first and second sections of the sheet member joined by an intermediate section that extends at an angle to the said first and second sections so as to orient the said first section in a plane substantially parallel to and spaced from the said handle section of the roller unit in the attached position of the brush unit to the roller unit, said clamp section of the roller unit formed with a hole in each leg of the U-shaped section, with a bolt mounted in one of said holes and threadably engaged to the other of said holes such that tightening of said bolt serves to adjustably clamp the legs of the clamp section together about the straight handle section of the roller unit, said handle section and said clamp section of a size to permit adjustment of the position of the bristles with respect to the roller in a direction parallel to the axis of the handle section when said bolt is loosened.

* * * * *